US007240523B2

(12) United States Patent
Johansson et al.

(10) Patent No.: US 7,240,523 B2
(45) Date of Patent: Jul. 10, 2007

(54) SLIDE LATCH ASSEMBLY

(75) Inventors: Henric Johansson, Husby-Rekarne (SE); Torsten Johansson, Eskilstuna (SE)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/108,628

(22) Filed: Apr. 18, 2005

(65) Prior Publication Data

US 2005/0229658 A1 Oct. 20, 2005

Related U.S. Application Data

(60) Provisional application No. 60/562,812, filed on Apr. 16, 2004.

(51) Int. Cl.
*E05B 65/08* (2006.01)

(52) U.S. Cl. ..... 70/99; 70/95; 70/131; 70/208; 292/8; 292/26

(58) Field of Classification Search ..... 70/107, 70/95–100, 131, 360, 150, 153, 208, 488, 70/481–485; 292/DIG. 46, 8, 14, 16, 24–26, 292/30, 48, 51, 53, DIG. 36–DIG. 37
See application file for complete search history.

(56) References Cited

U.S. PATENT DOCUMENTS 394,949 A * 12/1888 Ansher et al. ..... 70/150
1,933,865 A * 11/1933 Martinek ..... 70/97
2,518,141 A * 8/1950 Hiler ..... 70/79
2,844,020 A * 7/1958 Chittum et al. ..... 70/97
2,861,660 A * 11/1958 Ensign ..... 49/449
3,012,430 A * 12/1961 Spork ..... 70/99
3,034,327 A * 5/1962 Garmon, Jr. et al. ..... 70/70
3,120,748 A * 2/1964 Rechberg ..... 70/100
3,390,557 A * 7/1968 Erickson et al. ..... 70/97
4,155,233 A * 5/1979 Lira ..... 70/92
4,790,157 A * 12/1988 Lin ..... 70/95
5,373,716 A * 12/1994 MacNeil et al. ..... 70/109

* cited by examiner

*Primary Examiner*—Suzanne Dino Barrett
*Assistant Examiner*—Christopher Boswell
(74) *Attorney, Agent, or Firm*—Paul & Paul

(57) ABSTRACT

A slide latch assembly having a keyless toggle lock capability and capable of being unlocked by either a low level security key or a master key. When a user lifts up on the front grip piece or the rear grip piece of the latch assembly, a dual pawl rotary latch is opened so that the latch assemble can then be latched to a keeper. The lock cylinder can be provided with either a master annular ring on the front of the lock plug which can only be opened by a master key or a low level security annular ring which permits the lock cylinder to be opened by either the master key or the low level security key.

9 Claims, 10 Drawing Sheets

SLIDE LATCH ASSEMBLY

This application claims the benefit of U.S. Provisional Application No. 60/562,812 filed Apr. 16, 2004 the entire specification of which is incorporated by reference.

BACKGROUND OF THE INVENTION

The present invention relates generally to slide latch assemblies.

Slide latch assemblies are known in the art and are provided for the latching and the opening of a member such as a door or panel.

In addition, it is oftentimes desired that the lock cylinder of latches generally have the capability of being opened with a master key in addition to a lower level security key. This is particularly true in the case of marine applications where the individual members of a crew need access to individualized areas which the captain of the vessel also needs access to. However, there may be locked areas which are only to be accessible by the captain of the ship. In such cases, the captain would need a high level security key or master key to access his areas and also the crews areas.

In many prior art lock cylinders, the door or panel in which the lock cylinder was installed needed to be as thick as a significant portion of the length of the key which is inserted into the lock cylinder. This resulted in very long lock cylinders which oftentimes would protrude from the back side of the door or panel due to the length of the lock cylinders. Accordingly, due to space limitations it is desired to have a door or closure member which can accommodate a lock cylinder which is thin or in other words where the length of the axis of the lock cylinder is as short as possible so that the lock cylinder when installed in the door does not protrude from the front or back of the door.

A need therefore exists for a lock cylinder for a latch having a master key capability which can be accommodated in doors of a thickness which prior art lock cylinders could not be accommodated in.

A need exists for an ergonometric slide latch assembly which has an easy to use manual lock on one side of the latch assembly and a second lock which uses a key on the other side of the latch assembly.

The present invention has been developed in view of the foregoing and to overcome the deficiencies of the prior art.

SUMMARY OF THE INVENTION

In accordance with the present invention, it is an object of the invention to provide an ergonometric slide latch assembly which has an easy to use manual lock on one side of the latch assembly when the slide latch assembly is installed in a door or panel and a second lock on the other side of the slide latch assembly which uses a key.

It is an object to provide an improved lock cylinder having master key capability which is readily adaptable to different thicknesses of doors or closure members.

Another object of the present invention is to provide a door lock that is easy to operate.

A further object of the invention is to provide a lock cylinder which has a very low profile or thickness and which can be used in applications where space and thickness is a limiting factor.

It is a further object of the invention to provide a lock cylinder which can be fitted with two different annular rings, one of which is designed to operate the lock cylinder with only a master key and another which is to operate the lock cylinder with either a master key or a low level security key.

A further object of this invention is to provide such a lock cylinder with structural components which offers ease of assembly, and reliable operations.

The objects of the present are realized in a slide latch assembly for fastening and unfastening a closure member to a keeper in a latched position. The slide latch assembly is moveable between the latched position and an open position. The slide latch assembly comprises a latching means comprising a pawl actuator, a first rotary pawl which is rotatable, a second rotary pawl having a lever, said first rotary pawl engaging and rotating the second rotary pawl upon actuation of the lever by the pawl actuator such that said first rotary pawl and said second rotary pawl rotate into a latched position and engage the keeper. The latching means also comprises a biasing means which biases said pawl actuator to the latched position.

A locking module link is provided in the slide latch assembly for displacing the pawl actuator. The locking module link has a locking module link notch. The locking module has a toggle button which has a toggle button protuberance. The toggle button is capable of moving the toggle button protuberance such that the toggle button protuberance engages the locking module link notch thereby placing the slide latch assembly into a locked state in which movement of the locking module link is not permitted. The toggle button is also moveable into a position such that the toggle button protuberance does not engage the locking module link notch thereby placing the slide latch assembly in the unlocked state in which displacement of the locking module link is permitted.

The locking module has a lock cylinder having a lock plug which rotates a locking ring having a locking ring protuberance thereby providing for selective placement of the slide latch assembly into the locked state or the unlocked state upon rotation of a lock plug by the engagement of the locking ring protuberance with the toggle button.

A front grip piece is connected to the locking module link for displacing the locking module link such that the locking module link actuates the pawl actuator. A grip link is provided for displacing the front grip piece and a rear grip piece such that displacement of the rear grip piece or front grip piece actuates the pawl actuator.

The objects of the present invention are also realized in a lock cylinder configured for a key. Master key functionality is attained by adding an annular ring to the basic lock cylinder structure and modifying the profile of the low level security key. A separate key profile for each key is provided to provide the master key capability. A portion of one of the bits of the master key is machined deeper than the low level security key and has a key stop where the bit abuts the stem. When the lock cylinder is provided with a master annular ring, the lock cylinder can only be operated by the master key and not the limited access low level security key due to the presence of a tab on the master annular ring provided on the front of the lock cylinder which prevents entry of the limited access or low level security key into the lock cylinder. The master key can also operate the lock cylinder when the lock cylinder is fitted with a low level security annular ring which does not have the tab which is present on the master annular ring.

BRIEF DESCRIPTION OF THE DRAWINGS

The features, advantages and operation of the present invention will become readily apparent and further understood from a reading of the following detailed description of the invention with the accompanying drawings, in which like numerals refer to like elements, in which.

DETAILED DESCRIPTION OF THE INVENTION

Figure 30:
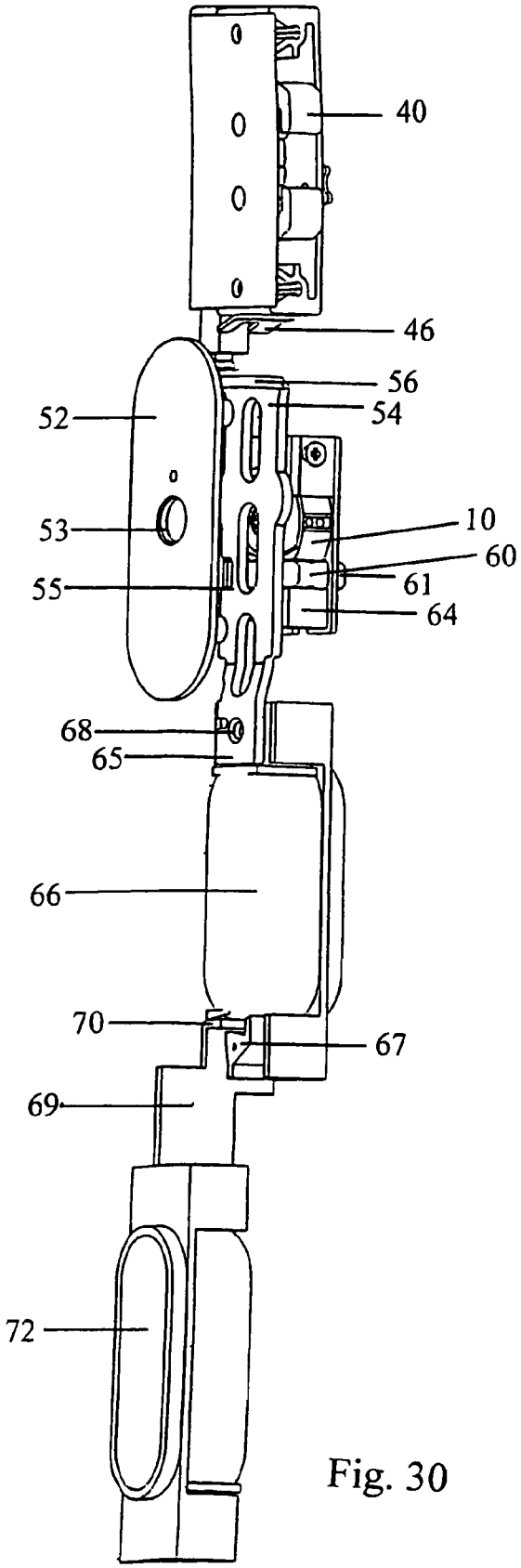
FIG. 30 is a rear perspective view of rear of the slide latch assembly of the present invention.
Figure 16:
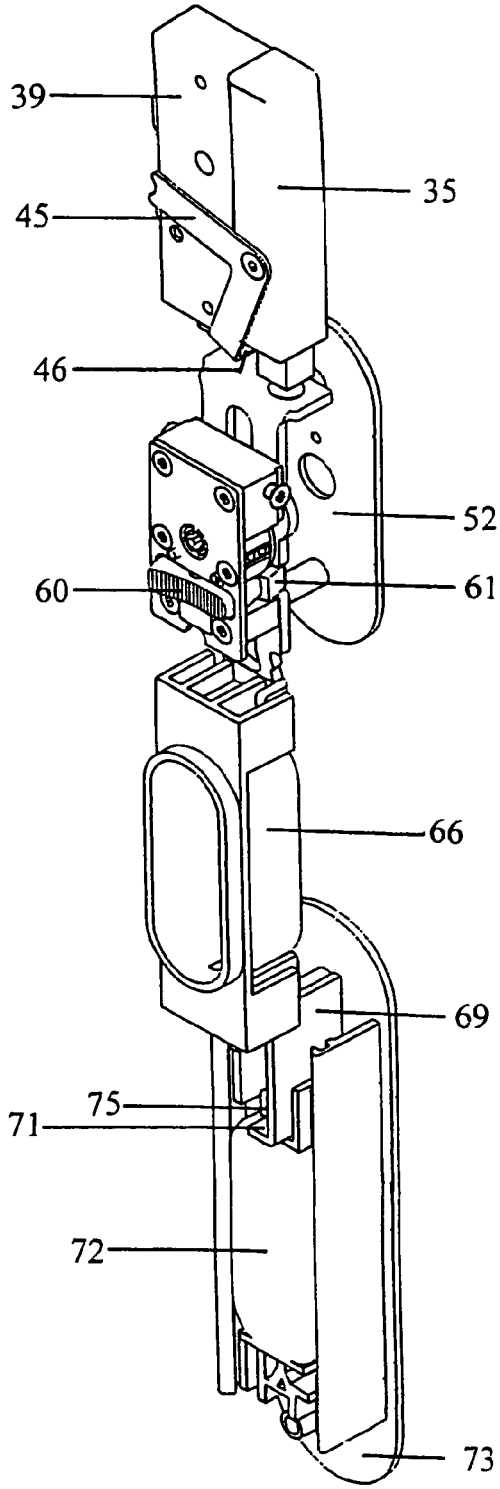
FIG. 16 is a rear perspective view of front of the slide latch assembly of the present invention.
Figure 18:
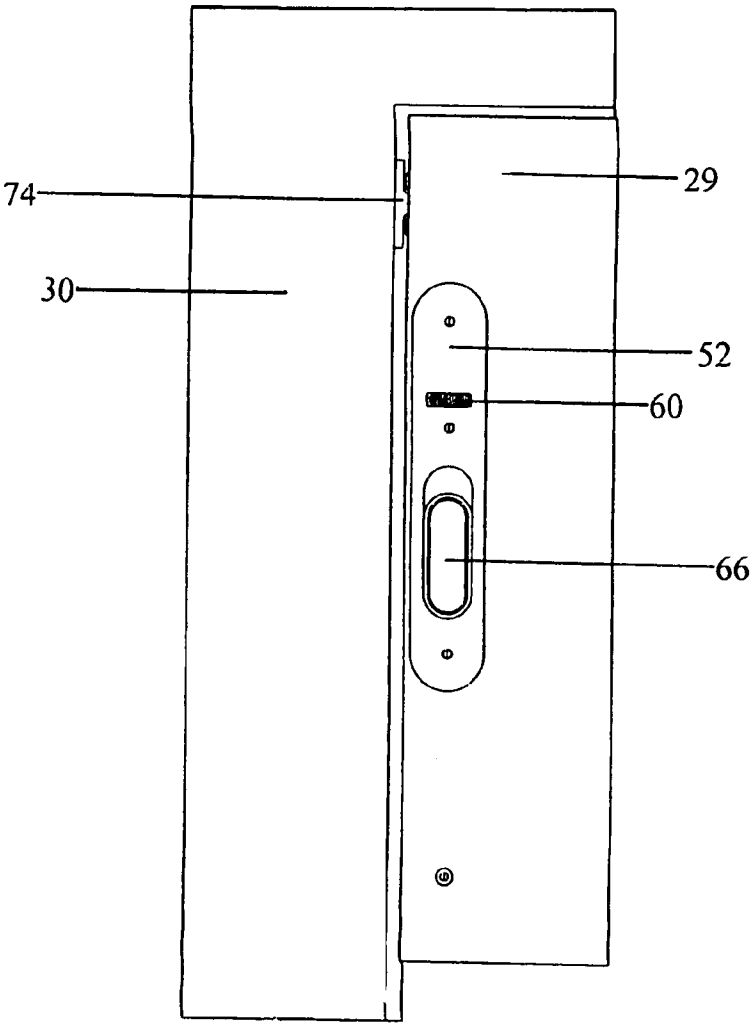
FIG. 18 is a front view of the slide latch assembly of the present invention in the latched position shown installed in a door such that the door is latched to a frame.
Figure 17:
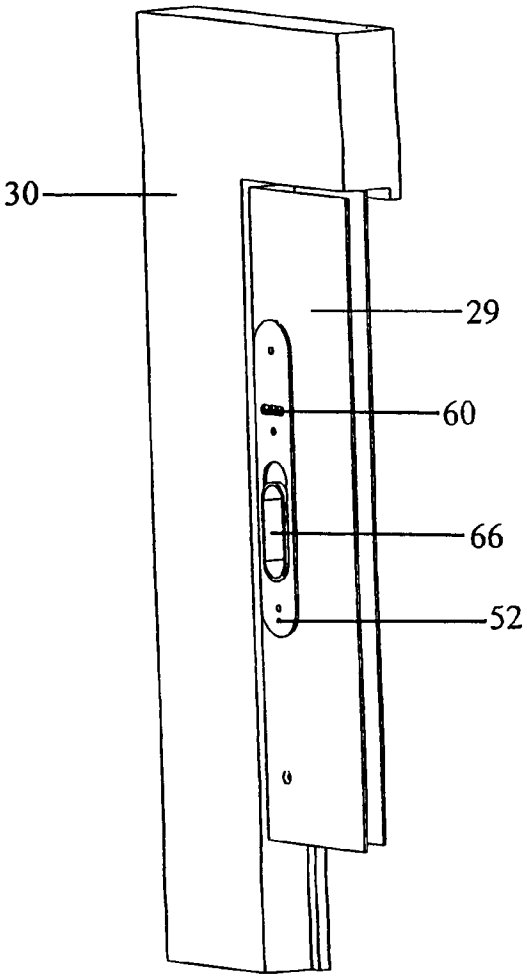
FIG. 17 is a perspective view of the slide latch assembly of the present invention in the latched position shown installed in a door such that the door is latched to a frame.
Figure 19:
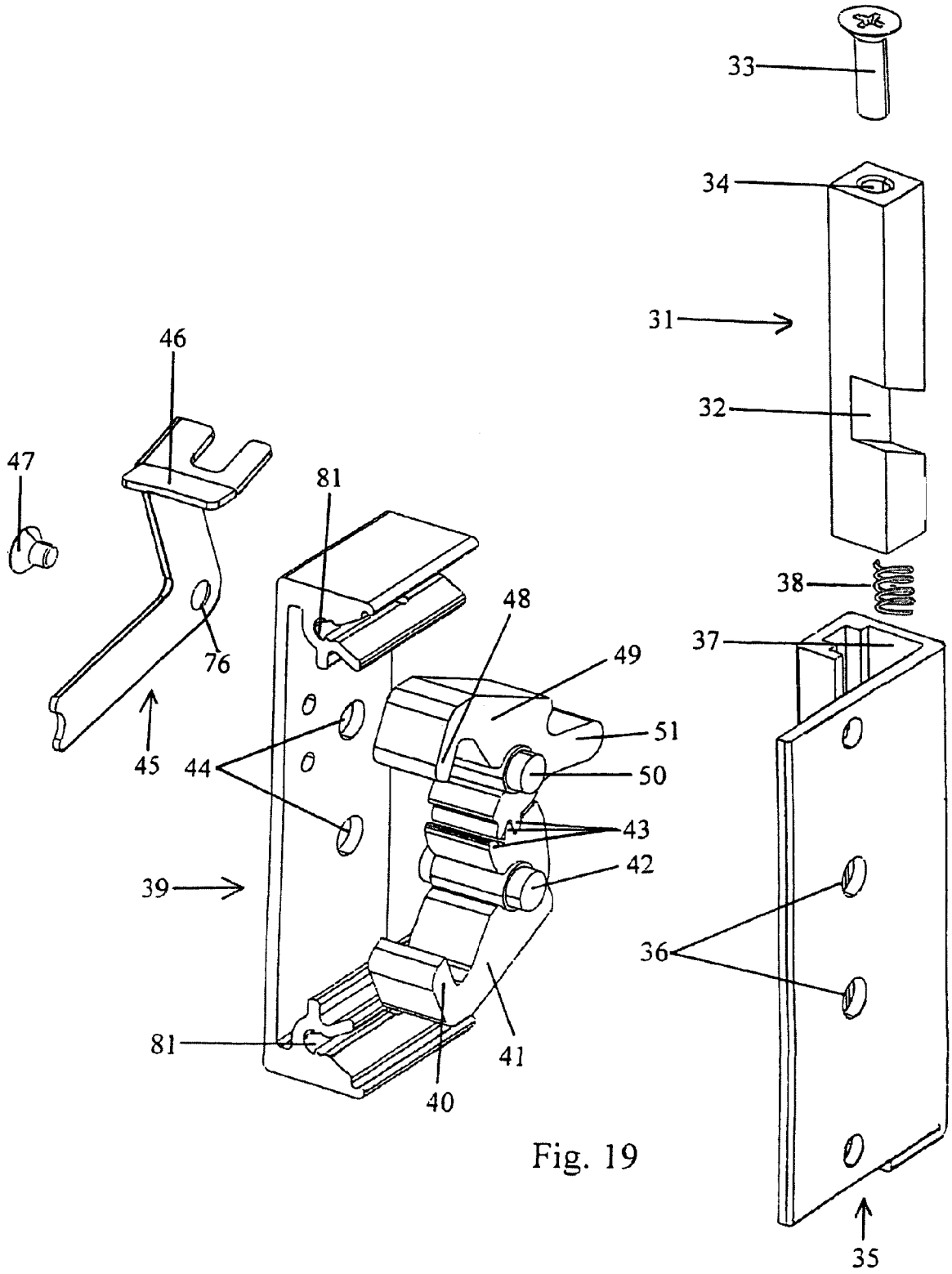
FIG. 19 is an exploded view of the latching means of the slide latch assembly of the present invention in the open position.
Figure 20:
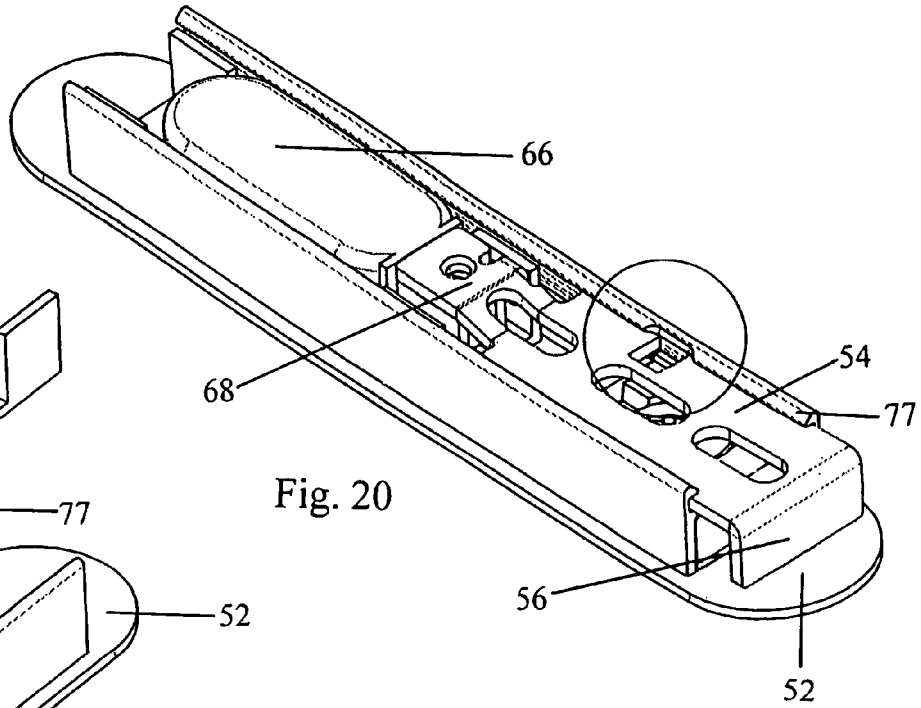
FIG. 20 is a perspective view of the front grip piece, locking module link and locking module installed in the locking module cover.
Figure 21:
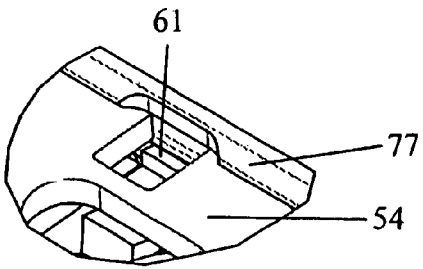
FIG. 21 is an enlarged detail view of a portion of FIG. 20.

The slide latch assembly is shown in FIGS. 16 and 30 in the latched position and the slide latch assembly is shown installed in FIGS. 17 and 18 in a door 29 which can be fastened by the slide latch assembly to frame 30. The slide latch assembly has a latching means. An exploded view of the latching means is shown in FIG. 19. The latching means comprises a pawl actuator 31, a first rotary pawl 41 which is rotatable about first rotary pawl pin 42. In the preferred embodiment shown, the first rotary pawl 41 has a first rotary pawl claw 40. A second rotary pawl 49 has a lever 51 and second rotary pawl claw 48 and rotates about second rotary pawl pin 50. The first rotary pawl 41 engages by the engagement of teeth 43 and rotates the second rotary pawl 49 upon actuation of the lever 51 by the pawl actuator 31 such that the first rotary pawl 41 and the second rotary pawl 49 rotate into a latched position and engage the keeper 74 shown in FIG. 18.

The latching means also comprises a biasing means 38 which biases the pawl actuator 31 to the latched position. In the embodiment shown the biasing means is a coil spring 38 which acts upon a face of the pawl actuator 31. The other end of the coil spring 38 presses against the bottom of the rotary latch rear cover piece 35 which can be held together with rotary latch front cover piece 39 by pins or screws which extend from rotary latch front cover piece apertures 44 to rotary latch rear cover piece apertures 36.

The pawl actuator 31 can be inserted into pawl actuator groove 37 and has a notch 32 and the pawl actuator 31 has pawl actuator screw hole 34 for pawl actuator screw 33. Assembly of the rotary latch latching means can be made much easier and the coil spring 38 can be held in a compressed state more easily by the presence of latch elbow 45 which is screwed on at latch elbow connecting means (here an aperture 76) to the rotary latch rear cover piece 35 by screw 47 into a screw hole (not shown) on the rotary latch rear cover piece 35. Latch elbow yoke 46 when rotated into position around pawl actuator screw 33 can hold the pawl actuator 31 in the compressed position. Front cover piece screw holes 81 are provided for the attachment of the latching means to a frame by a screw (not shown).

A locking module link 54 which features a locking module link actuator 56 for displacing the pawl actuator 31 is provided. The locking module link 54 has a locking module link notch 55. A locking module cover 52 which has locking module cover key aperture 53 can be mounted on the rear side of a closure member such as a door or panel and a user of the slide latch assembly could then insert a key in the locking module cover key aperture 53 and unlock the slide latch assembly and then pull the rear grip piece 72 toward the latching means to open the slide latch assembly.

Figure 1:
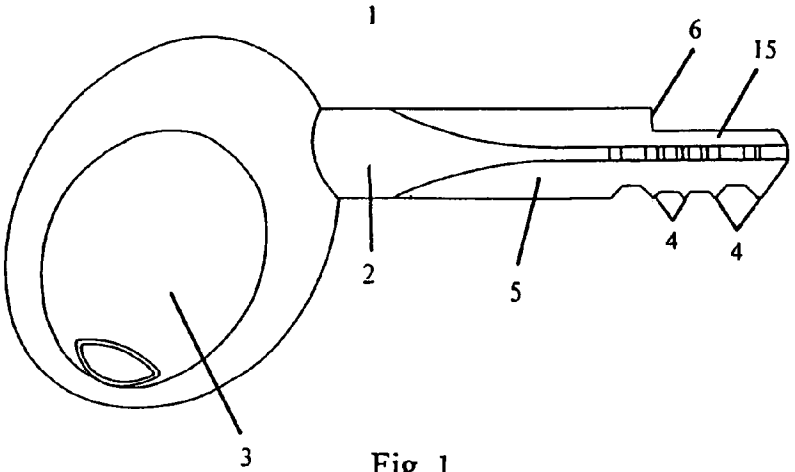
FIG. 1 is a side elevational view of the low level security key for use with one embodiment of the present invention.
Figure 3:
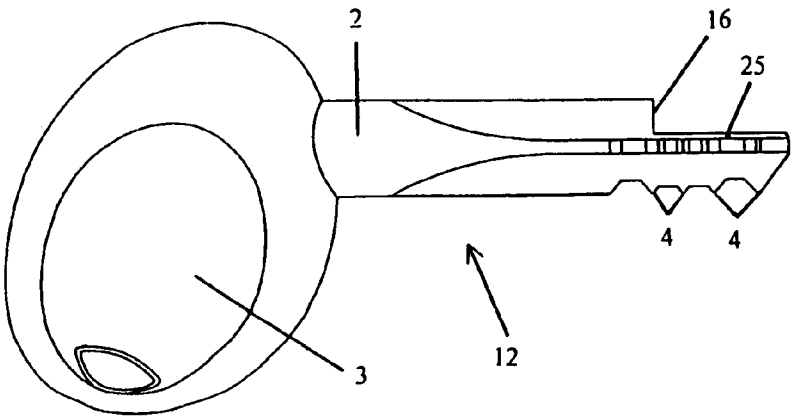
FIG. 3 is a side elevational view of the master key for use with one embodiment of the present invention.
Figure 23:
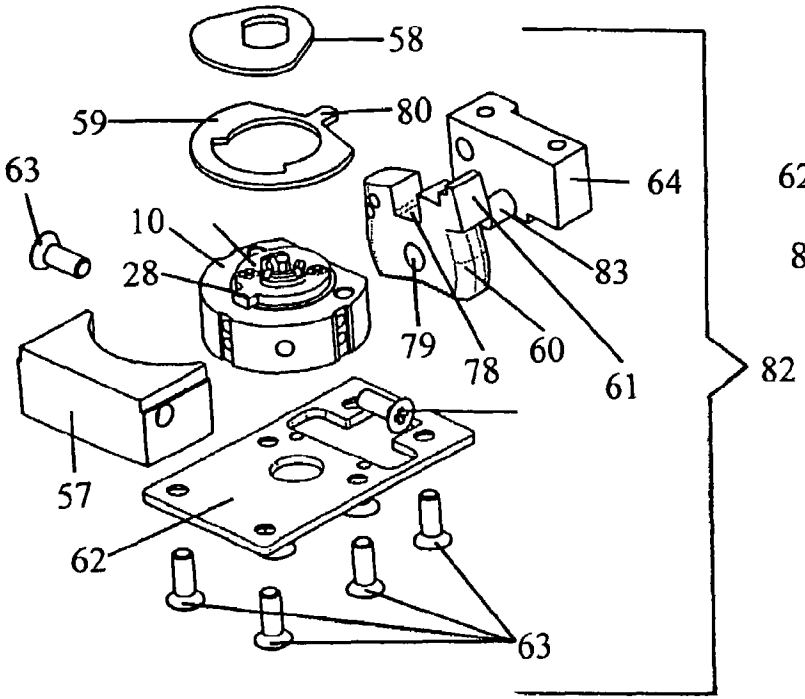
FIG. 23 is an exploded view of the locking module of the present invention in the locked position.
Figure 26:
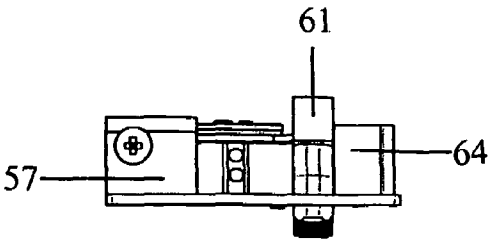
FIG. 26 is a side elevational view of the left side of the locking module of the present invention in the locked position.
Figure 27:
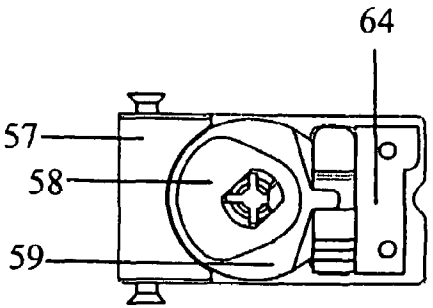
FIG. 27 is a bottom plan view of the locking module of the present invention in the locked position.
Figure 29:
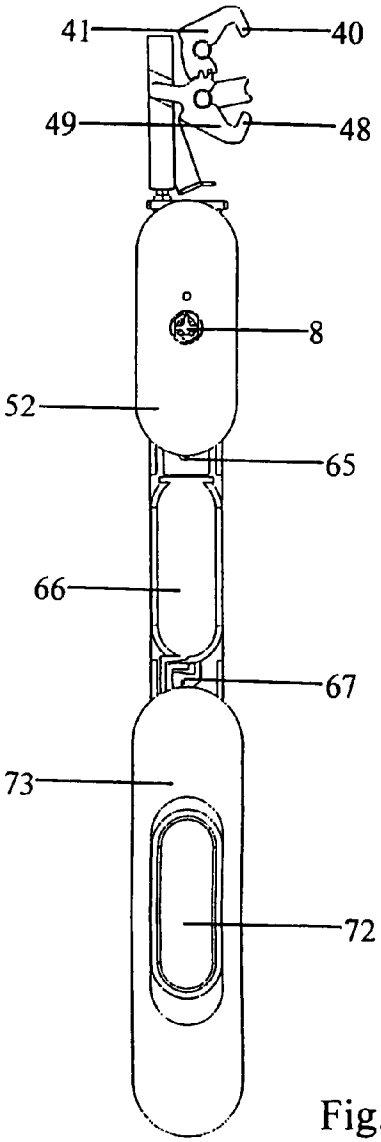
FIG. 29 is a perspective view of the slide latch assembly of the present invention in the open position shown with the shown with the rear grip piece cover and the front cover piece of the latching means removed.
Figure 28:
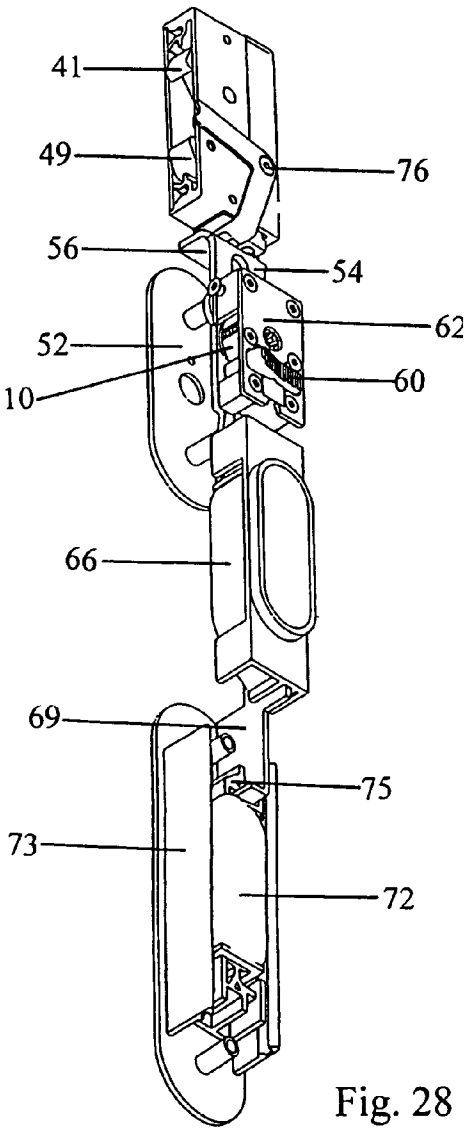
FIG. 28 is a perspective view of the slide latch assembly of the present invention in the open position.

The slide latch assembly can be locked an unlocked in two different ways: by either the use of a key, most preferably by low level security key 1 or master key 12 as shown in FIGS. 1 and 3 or by the operation of toggle button 60 on the locking module 82 shown in FIG. 23.

The locking module 82 has a toggle button 60 which has a toggle button protuberance 61. The toggle button 60 is capable of moving the toggle button protuberance 61 such that the toggle button protuberance 61 engages the locking module link notch 55 thereby placing the slide latch assembly into a locked state in which movement of the locking module link 54 is not permitted. The toggle button 60 is also moveable by, in the preferred embodiment shown, the rotation of the toggle button 60 about mounting block protuberance 83 such that the toggle button protuberance 61 does not engage the locking module link notch 55 thereby placing the slide latch assembly in the unlocked state in which displacement of the locking module link 54 is permitted. Toggle button 60 is mounted by way of toggle button aperture 79 on mounting block protuberance 83 which is on mounting block 64.

In the embodiment shown in FIGS. 23-26 and FIG. 11, the locking module 82 has a lock cylinder 13 having a lock plug 8 which rotates annular ring 7 which, in turn, rotates a locking ring 59 having a locking ring protuberance 80. When a user rotates a key for lockplug 8, selective placement of the slide latch assembly into the locked state or the unlocked state is provided for upon rotation of a lock plug 8 by the engagement of the locking ring protuberance 80 with the inner sides of toggle button notch 78 of toggle button 60. Locking ring spacer 58 is provided to rotate with lock plug 8 and provides for a preferred fit of the lock plug 8 in the locking module 82.

The lock plug 8 can be provided for access by the low level security key 1 or the master key 12 as described in detail below.

Figure 22:
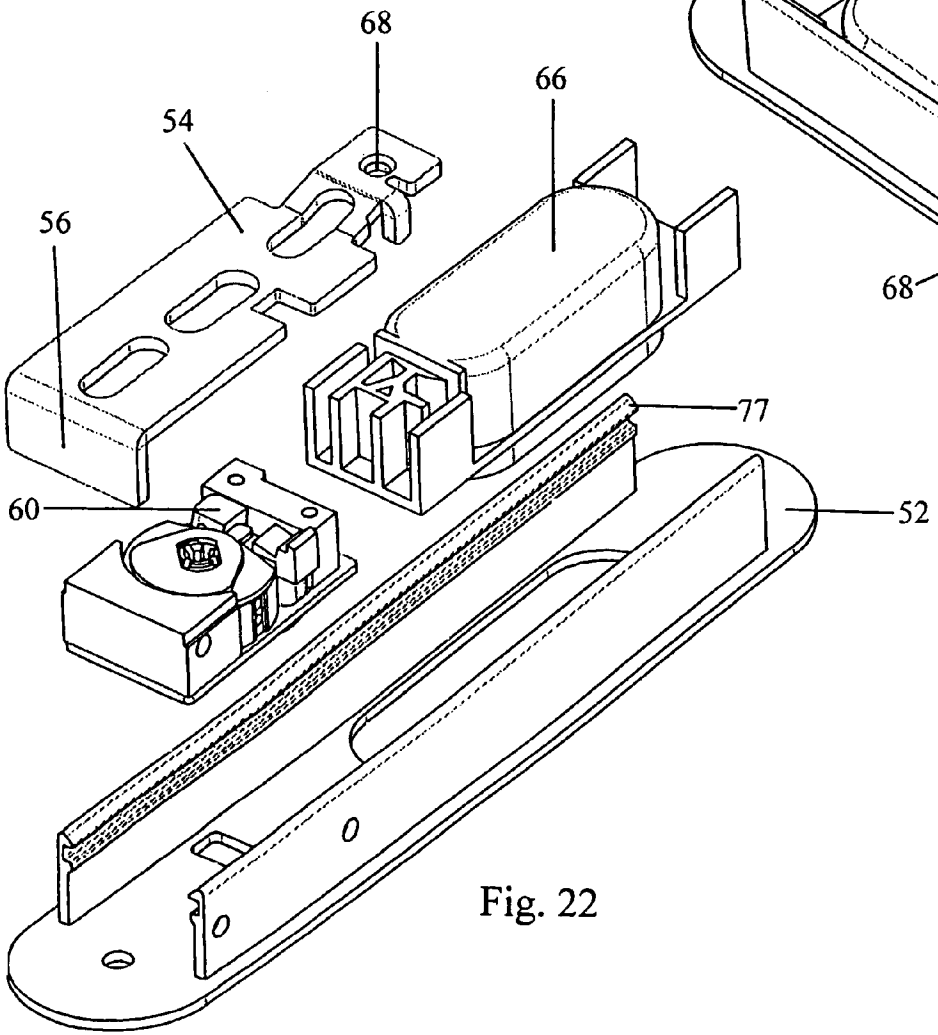
FIG. 22 is an exploded view of the front grip piece, locking module link and locking module installed in the locking module cover.
Figure 25:
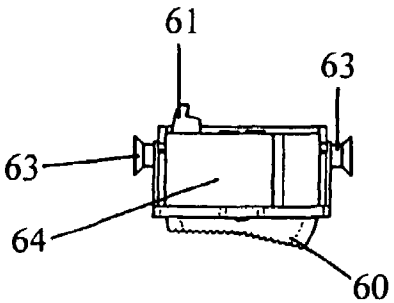
FIG. 25 is a side elevational view of the bottom end of the locking module of the present invention in the locked position.
Figure 24:
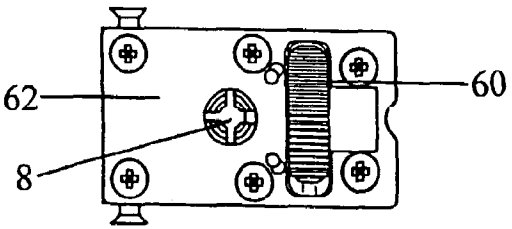
FIG. 24 is a top plan view of the locking module of the present invention in the locked position.

Lock cylinder mount 57 and locking module cover plate 62 are provided with screws 63 to assemble the locking module 82 as can be seen in the exploded view of FIG. 22 which shows locking module cover 52 which has locking module cover lip 77 which provides a means to secure the locking module 82, front grip piece 66 and locking module link 54.

Front grip piece 66 is connected to the locking module link 54 for displacing the locking module link 54 such that the locking module link 54 actuates the pawl actuator 31 by contact of locking module link actuator 56 upon pawl actuator 31. Locking module link 54 is connected to front grip piece 66 at locking module link connecting means 65 at screw hole 68 as seen in FIG. 30 by a screw (not shown) which goes into front grip piece 66. Front grip piece 66 has front grip piece connecting means 67 which provides for connection to grip link front connecting means 70 which permits front grip piece 66 to displace grip link 69.

Grip link 69 provides for, in this preferred embodiment, the simultaneous displacement of the front grip piece 66, and rear grip piece 72 as the grip link rear connecting means 71 connects to the rear grip piece connecting means 75. Rear grip piece cover 73 provides, in this preferred embodiment, for the longitudinal sliding displacement of the rear grip piece 72 and the grip link 69.

This allows for a user who is present on the rear side of the slide latch assembly and faces locking module cover 52 which is on the rear side of the slide latch assembly to open the slide latch assembly by an upward motion of the rear grip piece 72 when the slide latch assembly is in an unlocked state from the read side. Thus, upward displacement of the rear grip piece 72 in the direction of the pawl actuator 31 actuates the pawl actuator 31, and allows the user to latch a door or panel in which the slide latch assembly is installed to a keeper.

In a preferred embodiment of the present invention, the locking module 82 is adapted for use with a low level security and/or a master key.

Figure 5:
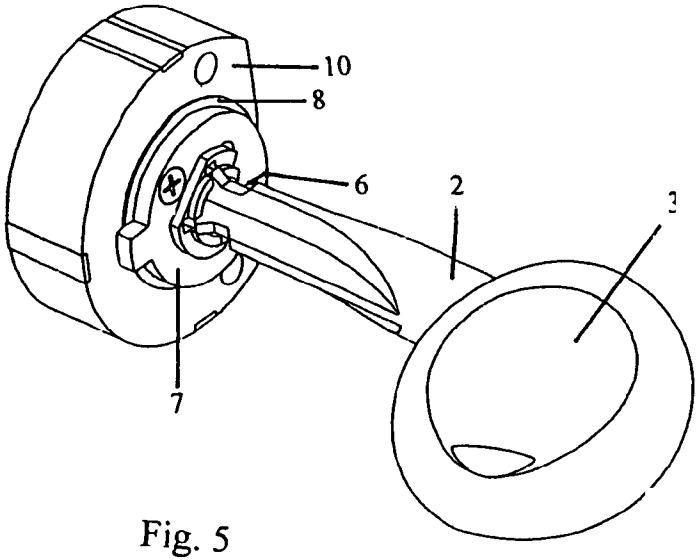
FIG. 5 is a perspective view of the lock cylinder and low level security key for use with one embodiment of the present invention in a locked state shown with a low level security annular ring.
Figure 7:
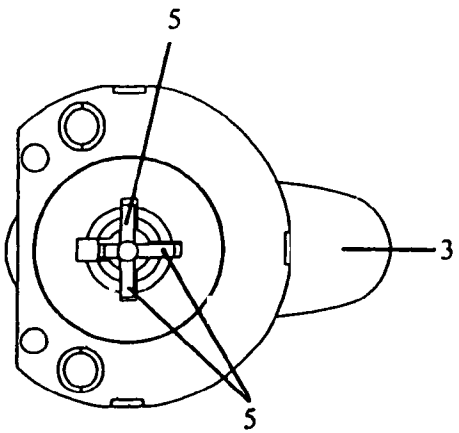
FIG. 7 is a rear elevational view of the lock cylinder and low level security key for use with one embodiment of the present invention in a locked state shown with a low level security annular ring.
Figure 9:
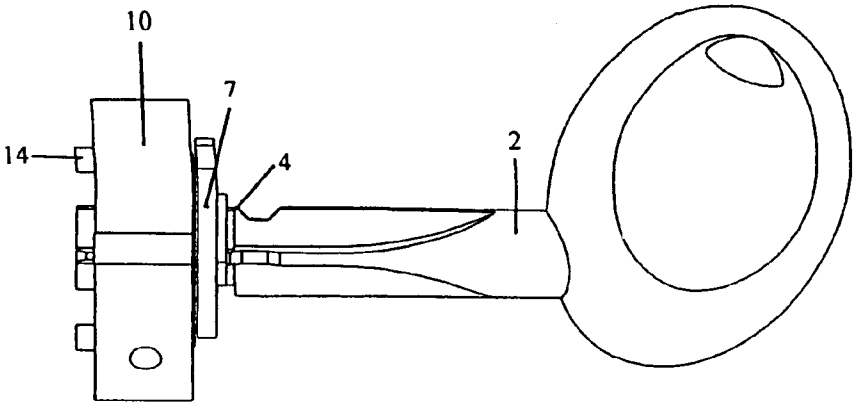
FIG. 9 is a side elevational view of the lock cylinder and low level security key for use with one embodiment of the present invention in an unlocked state shown with a low level security annular ring.

As seen in FIG. 1, low level security key 1 has grip portion 3 to be held by a user of the low level security key 1 and a stem 2 extending from the grip portion 3. Individual bittings 4 are formed on at least one of the bits of the low level security key 1. Stem 2 of the key 1 which is preferably cylindrical in cross section extends from the grip portion 3 to the bits of the low level security key 1. As shown in this embodiment the low level security key 1, one end of the low level security key 1 is in a star profile as seen in FIG. 7 and has three bitted bits 5. The fourth bit which forms part of the remaining portion of the star profile is the low level security key stop bit 15 which terminates in a low level security key stop 6. Low level security key 1 is dimensioned and configured to be inserted into lock cylinder 13 which has low level security annular ring 7 as seen in FIG. 5 until low level security key stop 6 contacts low level security annular ring 7 which thereby prevents further insertion of low level security key 1 into lock plug 8.

The low level security key stop 6 has a depth equal to the difference between the distance from the top of the low level security key stop bit 15 to the axis of low level security key 1 and the distance from the top of the low level security key stop 6 to the axis of the low level security key, wherein the depth of the low level security key stop 6 is less than the depth of the master key stop 16.

Figure 6:
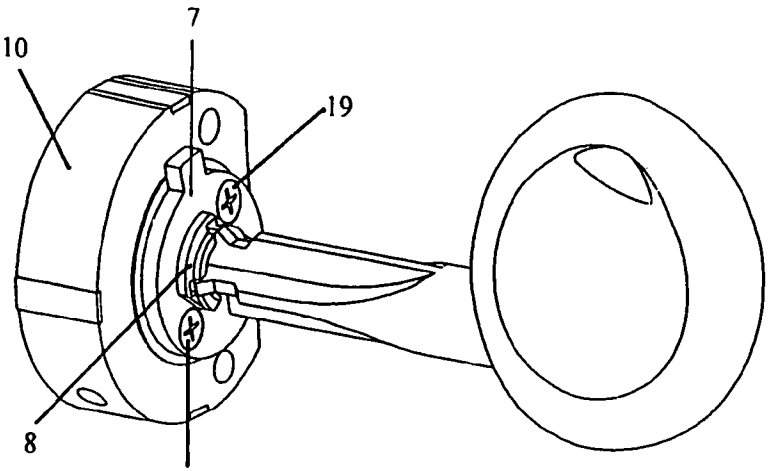
FIG. 6 is a perspective view of the lock cylinder and low level security key for use with one embodiment of the present invention in an unlocked state shown with a low level security annular ring.
Figure 8:
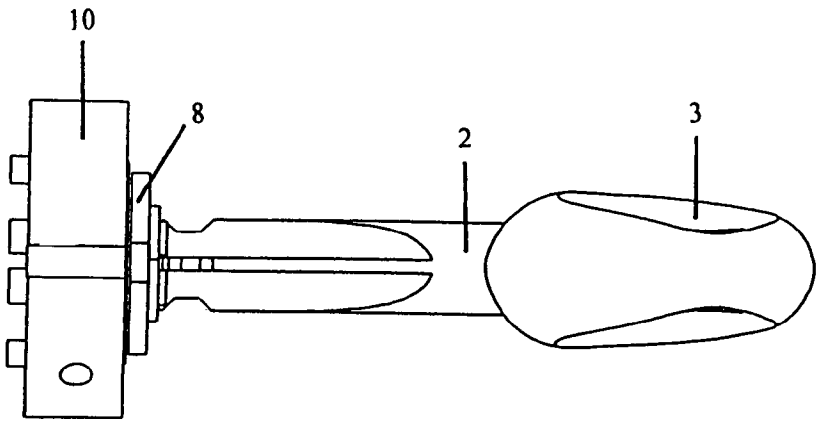
FIG. 8 is a side elevational view of the lock cylinder and low level security key for use with one embodiment of the present invention in a locked state shown with a low level security annular ring.

When the lower level security key 1 or master key 12 is inserted, one or more of the bitted bits 5 engage tumblers (not shown) in the lock plug 8 and lock shell 10 which in the locked state extend from lock plug apertures 24 in the lock plug 8 into corresponding lock shell apertures 24 in lock shell 10. After insertion of the low level security key 1, the bitted bits 5 push and align the tumblers which are preferably biased by a biasing means such as a coil spring into positions such that none of the tumblers contacts simultaneously both the lock plug 8 and the lock shell 10 thereby permitting rotation of the lock shell 10 relative to lock plug 8. A user then turns grip portion 3 of the low level security key 1 in a clockwise direction as seen in FIG. 6 to unlock the lock plug 8 from the lock shell 10.

Figure 2:
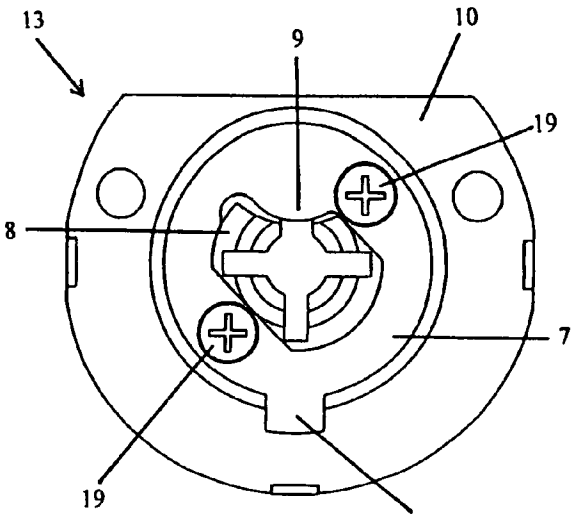
FIG. 2 is a front elevational view of the lock cylinder for use with one embodiment of the present invention having a low level security annular ring.

Lock cylinder 13 of FIG. 2 which is shown with low level security annular ring 7 also accommodates master key 12 of FIG. 3 as the depth of master key stop 16 is sufficiently deep as measured from the top of the master key stop 16 to the top of the master key stop bit 25 to permit passage of the master key 12 into the lock plug 8 until master key stop 16 is prevented from being inserted further into the lock plug 8 by contact with ring stop 9 on low level annular ring 7. The master key stop 16 has a depth equal to the difference between the distance from the top of the master key stop bit 25 to the axis of the master key 12 and the distance from the top of the master key stop 16 to the axis of the master key 12. Therefore, lock cylinder 13 when provided with the low level annular ring 7 can be operated with either the master key 12 or low level security key 1.

Figure 4:
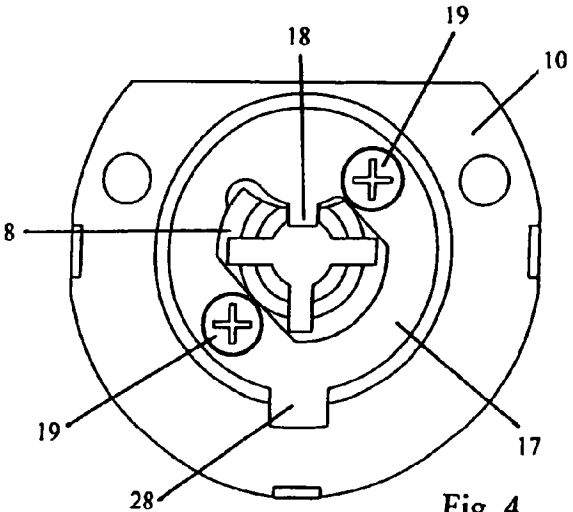
FIG. 4 is a front elevational view of the lock cylinder for use with one embodiment of the present invention having a master annular ring.

In FIG. 4, the same lock plug 8 and lock shell 10 as seen in FIG. 2 is provided, however a master annular ring 17 is shown screwed to the front of the lock plug 8 by screws 19. The master annular ring 17 is different from the low level annular ring 7 of FIG. 2 in that the master annular ring 17 has a tab 18 which prevents insertion of low level security key 1 into lock plug 8. The low level security key 1 is prevented from being inserted into the lock plug 8 by the contact of low level key stop 6 against tab 18. On the other hand, master key 12 can be inserted into lock plug 8 in FIG. 4 because of the greater depth of master key stop 16 which permits passage of the master key stop bit 25 below tab 18. Accordingly, master key 12 can function as a master key which has the capability of opening both the lock cylinder 13 when it is provided with a low level security annular ring 7 and the lock cylinder 13 when it is provided with a master annular ring 17.

In the same way if a user were to try to insert the low level security key 1 in the lock cylinder 13 while the lock cylinder 13 is fitted with a master annular ring, the bit 15 would be blocked from entering the lock cylinder 13 by tab 18 on the master annular ring 17.

Figure 11:
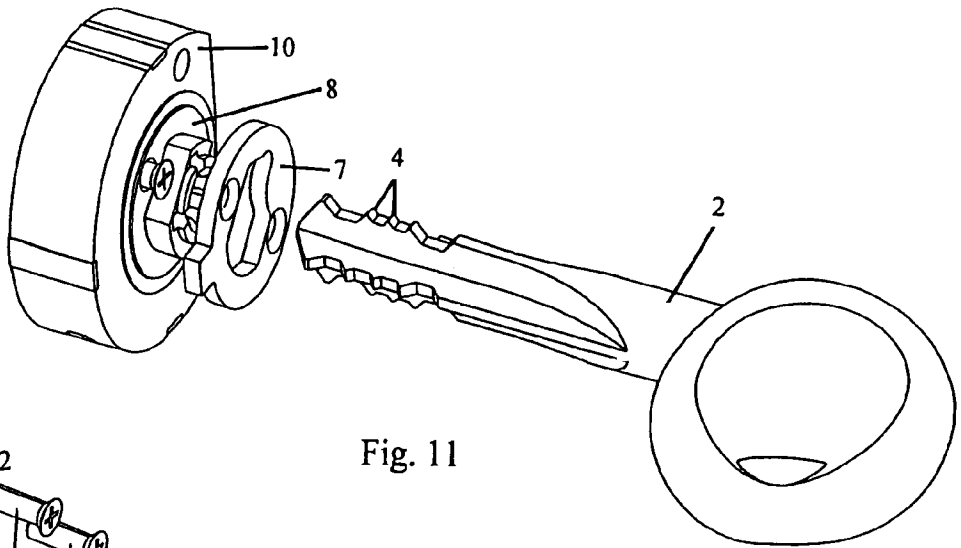
FIG. 11 is an exploded view of the lock cylinder and low level security key for use with one embodiment of the present invention in a locked state shown with a low level security annular ring.
Figure 10:
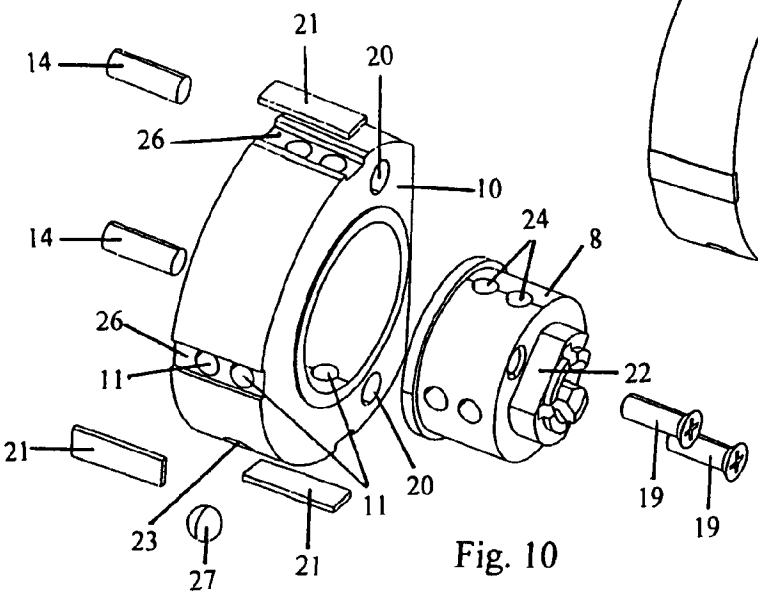
FIG. 10 is an exploded view of the lock cylinder for use with one embodiment of the present invention without either a master annular ring or a low level security annular ring.

FIGS. 10 and 11 show an exploded view of the lock cylinder 13 of the present invention having shell 10 and lock plug 8. In order to provide for mounting of the lock cylinder 13 in a latch, prongs 14 are provided mounted in an apertures 20 in the lock shell 10. Also, the lock shell 10 is provided with grooves in which plates 21 are fitted to keep biasing means, i.e. coil springs, and tumblers in the lock shell 10 and lock plug 8. Lock plug 8 is also fitted with ring support 22 which serves to maintain the relative position of either the master annular ring 17 or the low level security annular ring 7. In a preferred embodiment, the lock shell 10 is fitted with a ball bearing aperture 23 in which ball bearing 27 is located together with a biasing means (not shown) such as a coil spring. The ball bearing 27 in the ball bearing aperture 23 is biased toward the lock plug 8 which has a detent (not shown) in which a portion of the ball bearing 27 will rest when the lock plug 8 is properly aligned with lock shell 10.

Preferably, the lock plug 8 is located concentric to and rotatable inside of and relative to said lock shell 10, and said lock plug 8 is configured for insertion of said master key 12 or said low level security key 1.

Figure 12:
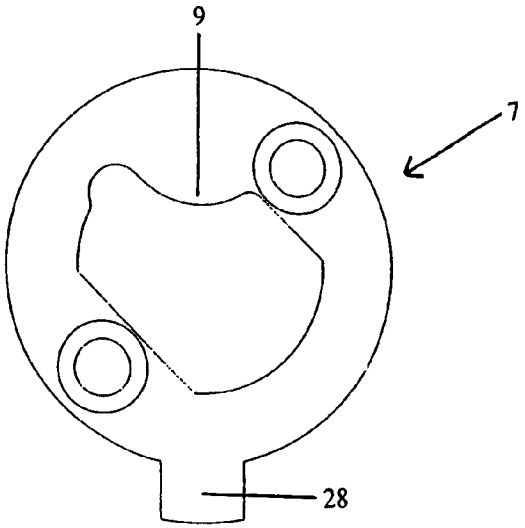
FIG. 12 is a top plan view of the low level security annular ring for use with one embodiment of the lock cylinder of the present invention.
Figure 13:
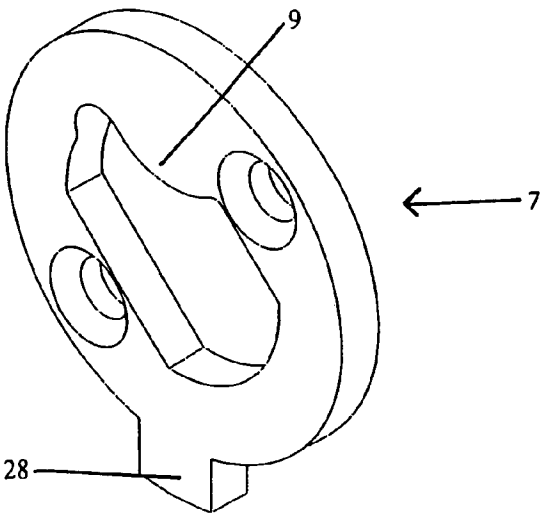
FIG. 13 is a perspective view of the low level security annular ring for use with one embodiment of the lock cylinder of the present invention.
Figure 14:
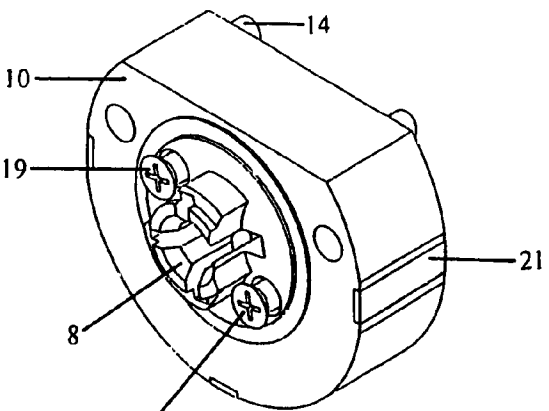
FIG. 14 is a perspective view of the lock cylinder for use with one embodiment of the present invention shown without a low level security annular ring or a master annular ring.
Figure 15:
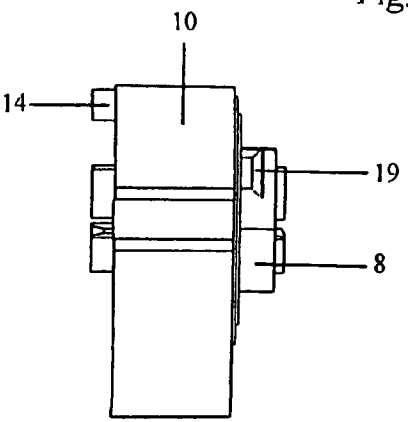
FIG. 15 is a side view of the lock cylinder for use with one embodiment of the present invention shown without a low level security annular ring or a master annular ring.

Low level security annular ring 7 as shown in FIGS. 12 and 13 has a ring stop 9 which contacts key stop 6 when the low level security key 1 is used and which contacts master key stop 16 when the master key 12 is used. The ring stop 9 can be of any shape which permits insertion of the master key 12 and the low level security key 1 into the lock plug 8 but acts as a stop against a portion of the master key stop 16 or low level security key stop 6 respectively. The tab 18 of the master annular ring 17 can be of any shape, thickness or configuration which permits insertion of the master key 12 up to the master key stop 16 but which does not permit insertion of the low level security key 1 due to contact of the low level security key stop bit 15 against the tab 18.

Tab 18 extends into an interior portion of the ring formed by the master annular ring 17 and the tab 18 permits insertion of the master key stop bit 25 into the lock plug 8 until the master key stop 16 contacts the tab 18 on the master annular ring 17.

Actuator 28 on master annular ring 17 or low level annular ring 7 which are both preferably in the form of a ring actuate the means by which the latch or lock in which the lock cylinder 13 is unlocked when a user unlocks the lock cylinder 13 and rotates either the master key 12 or low level security key 1.

As can be seen by a comparison of FIG. 1 and FIG. 3, a master key and a low level security key can preferably be provided which can have identical bittings on the bits of the two keys. However, when the basic lock cylinder configuration of a lock plug and lock shell is provided with a master annular ring then only the master key can open the lock cylinder. However, the lock cylinder can be opened by a low level security key or master key when the lock cylinder is fitted with the low level security annular ring.

Many changes can be made in the above-described invention without departing from the intent and scope thereof. It is therefore intended that the above description be read in the illustrative sense and not in the limiting sense. Substitutions and changes can be made without departing from the scope and intent of the invention.

We claim:

1. A slide latch assembly for fastening a closure member to a keeper in a latched position, said slide latch assembly being capable of assuming a latched configuration in which said slide latch assembly engages the keeper, and said slide latch assembly being capable of assuming an unlatched configuration, said slide latch assembly comprising:

a latching means for engaging the keeper when said slide latch assembly is in said latched configuration and when the closure member is in a closed position relative to the keeper, said latching means having a biasing means for biasing said latching means into engaging the keeper when said slide latch assembly is in said latched configuration and the closure member is in a closed position relative to the keeper, a locking module link for actuating said latching means, said locking module link being slidable relative to said latching means, said locking module link having a locking module link notch;

a locking module adapted to be fixed relative to the closure member, said locking module having a toggle button, said toggle button having a toggle button protuberance, said toggle button being pivotable between a locked state in which said toggle button protuberance engages said locking module link notch thereby preventing sliding movement of said locking module link relative to said latching means and an unlocked state in which said toggle button protuberance does not engage said locking module link notch thereby permitting sliding of said locking module link relative to said latching means, said locking module further including a lock cylinder, said lock cylinder having a means for engaging said toggle button such that rotation of said lock cylinder pivots said toggle button between said locked state and said unlocked state; and a grip piece slidable relative to said latching means and connected to said locking module link such that upon sliding of said grip piece relative to said latching means said locking module link actuates said latching means, wherein said latching means comprises:

a pawl actuator;

a first rotary pawl, said first rotary pawl being rotatable between a latched position corresponding to said latched configuration of said slide latch assembly and an unlatched position corresponding to said unlatched configuration of said slide latch assembly;

a second rotary pawl, said second rotary pawl being rotatable between a latched position corresponding to said latched configuration of said slide latch assembly and an unlatched position corresponding to said unlatched configuration of said slide latch assembly, said second rotary pawl having a lever, said first rotary pawl being rotated by said second rotary pawl upon actuation of said lever by said pawl actuator such that said first rotary pawl and said second rotary pawl rotate into their respective latched positions and engage the keeper;

whereby sliding of said grip piece and said locking module link relative to said latching means actuates said pawl actuator and thus actuates said latching means.

2. The slide latch assembly according to claim 1 wherein said biasing means is a coil spring.

3. The slide latch assembly according to claim 1 wherein said pawl actuator is displaceable in said latching means, said pawl actuator having an engagement means for engaging said lever of the second pawl.

4. The slide latch assembly according to claim 3 wherein said engagement means of said pawl actuator is a notch.

5. The slide latch assembly of claim 1, wherein said latching means further comprises a yoke having two arms and a pivot means for pivoting of the yoke between a released position and an engaged position in which one of said arms engages with an end of said pawl actuator, each of said two arms of said yoke extending from said pivot means.

6. The slide latch assembly of claim 1, wherein said means for engaging said toggle button is a locking ring on said lock cylinder, said locking ring having a locking ring protuberance which pivots said toggle button between the locked state and the unlocked state.

7. The slide latch assembly according to claim 1, wherein said first rotary pawl and said second rotary pawl have teeth that are in engagement such that rotation of one of said first rotary pawl and said second rotary pawl causes the rotation of the other one of said first rotary pawl and said second rotary pawl.

8. A slide latch assembly for fastening a closure member to a keeper in a latched position, said slide latch assembly being capable of assuming a latched configuration in which said slide latch assembly engages the keeper, and said slide latch assembly being capable of assuming an unlatched configuration, said slide latch assembly comprising:

a latching means for engaging the keeper when said slide latch assembly is in said latched configuration and when the closure member is in a closed position relative to the keeper, said latching means having a biasing means for biasing said latching means into engaging the keeper when said slide latch assembly is in said latched configuration and the closure member is in a closed position relative to the keeper, a locking module link for actuating said latching means, said locking module link being slidable relative to said latching means, said locking module link having a locking module link notch;

a locking module adapted to be fixed relative to the closure member, said locking module having a toggle button, said toggle button having a toggle button protuberance, said toggle button being pivotable between a locked state in which said toggle button protuberance engages said locking module link notch thereby preventing sliding movement of said locking module link relative to said latching means and an unlocked state in which said toggle button protuberance does not engage said locking module link notch thereby permitting sliding of said locking module link relative to said latching means, said locking module further including a lock cylinder, said lock cylinder having a means for engaging said toggle button such that rotation of said lock cylinder pivots said toggle button between said locked state and said unlocked state; and a grip piece slidable relative to said latching means and connected to said locking module link such that upon sliding of said grip piece relative to said latching means said locking module link actuates said latching means.

9. The slide latch assembly of claim 8, wherein said means for engaging said toggle button is a locking ring on said lock cylinder, said locking ring having a locking ring protuberance which pivots said toggle button between the locked state and the unlocked state.

* * * * *

UNITED STATES PATENT AND TRADEMARK OFFICE

CERTIFICATE OF CORRECTION

PATENT NO. : 7,240,523 B2
APPLICATION NO. : 11/108628
DATED : July 10, 2007
INVENTOR(S) : Johansson et al.

It is certified that error appears in the above-identified patent and that said Letters Patent is hereby corrected as shown below:

Column 2,
Line 6, after the word “present” insert --invention--

Column 4,
Line 20, remove the words “shown with the”

Column 5,
Line 11, replaces the word “an” with --and--

Column 6,
Line 10, replaces the word “read” with --rear--

Column 6,
Line 47, replaces the words “lock shell apertures 24” with --lock shell apertures 11--

Column 9,
Line 21, insert the word --rotary-- after the word “second”

Signed and Sealed this

Twenty-third Day of October, 2007

JON W. DUDAS
*Director of the United States Patent and Trademark Office*